US006530743B1

(12) United States Patent
Barrett

(10) Patent No.: US 6,530,743 B1
(45) Date of Patent: Mar. 11, 2003

(54) HEAT TRANSFER FAN

(76) Inventor: Terry Thomas Barrett, 3030 Yarwood, El Paso, TX (US) 79935-1732

( * ) Notice: Subject to any disclaimer, the term of this patent is extended or adjusted under 35 U.S.C. 154(b) by 0 days.

(21) Appl. No.: 09/986,969

(22) Filed: Nov. 13, 2001

(51) Int. Cl.[7] ..... F01D 3/02
(52) U.S. Cl. ..... 415/101; 415/206
(58) Field of Search ..... 415/98, 101, 102, 415/103, 204, 206

(56) References Cited

U.S. PATENT DOCUMENTS 4,102,596 A * 7/1978 Itayama ..... 415/101
4,102,597 A * 7/1978 Itayama ..... 415/101

FOREIGN PATENT DOCUMENTS

JP 61028794 A * 2/1986 ..... F04D/29/28

OTHER PUBLICATIONS

Fans Ashrae Handbook, Chapter 3, pp. 3.1–3.4, Equipment 1988.
Air–to–Air Energy–Recovery Equipmennt, Ashrae Handbook, Chapter 34, pp. 34.1–34.18, Equipment 1988.

* cited by examiner

*Primary Examiner*—Edward K. Look
*Assistant Examiner*—Richard A. Edgar

(57) ABSTRACT

Herein presented is a unique device for energy recovery. The centrifugal fan blades assembly of the device provides both the counter flow of air streams and the transfer of energy between the air streams. All the components of the device, the fan blades assembly, flow stream channels and air seals are housed together in a single economical unit.

1 Claim, 2 Drawing Sheets

HEAT TRANSFER FAN

BACKGROUND OF THE INVENTION

For eons man has attempted to control his environment. Modern man works and lives in buildings with controlled environments. Many devices for conditioning the air have become sophisticated and complex. One device, the centrifugal fan, has changed little in design. The centrifugal fan takes in air parallel to its axis of rotation. It discharges the air perpendicular to its axis of rotation. The various blades that are manufactured for use on the centrifugal fan are designed to direct air flow. Only their performance characteristics differ.

The blades of the centrifugal fan device presented here are uniquely designed to provide energy recovery and transfer as well as: direct air flow. All the components of the device are made and arranged to facilitate the blades in these tasks. All the components of the device are housed together in a single unit.

The housing of the device has four openings. The remainder of the housing of the device is air sealed. The device takes in new air from an outside environment and channels it through its blades; and then directs the flow to an inside environment. The device simultaneously takes in old air from the inside environment and channels it through its blades; and then directs the flow to the outside environment. The two air flows do not mix while in the device. The heat of the outside air contacts the uniquely shaped blades of the device and is transferred through the blades to the surfaces in contact with the old inside environment air. The heat is then transferred to the old inside environment air and exhausted. Thus energy is recovered from the cooler inside environment air.

SUMMARY OF THE INVENTION

The invention herein is a unique centrifugal fan device for directing air flow and providing energy recovery. The device has uniquely designed blades. The blades of the device move the air from an outside environment to an inside environment. At the same time the blades of the device move air from the inside environment to an outside environment. Again at the same time the blades of the device transfer heat from the air from the outside environment that has entered the device to the air from the inside environment that is exiting the device.

The two air streams that are flowing through the device never come in direct contact. The housing, blades assembly and rotating shaft wheels of the device prevent any mixing of the two streams.

BRIEF DESCRIPTION OF THE DRAWINGS

The invention can be better understood by examining the following in connection with the accompanying drawings to wit.

DESCRIPTION OF THE PREFERRED EMBODIMENTS

Figure 1:
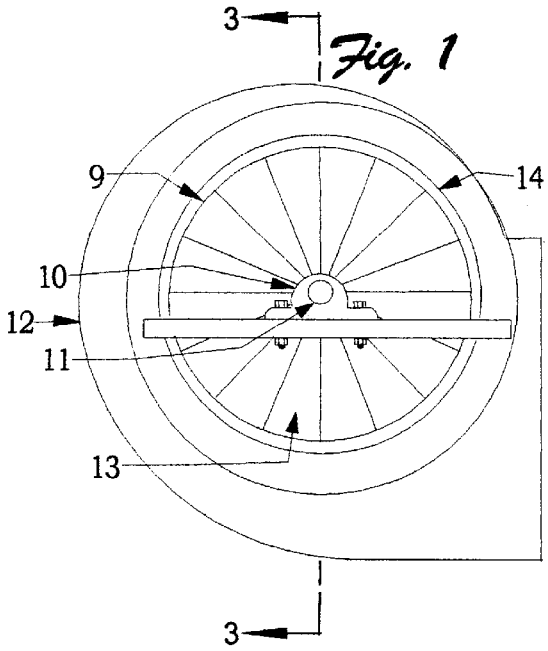
FIG. 1 is a plain side view of the centrifugal device that has an entrance opening.
Figure 2:
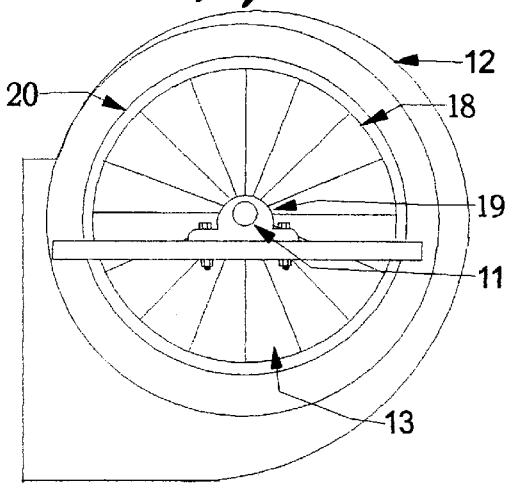
FIG. 2 is a plain opposite side view of the centrifugal device that has another entrance opening.
Figure 3:
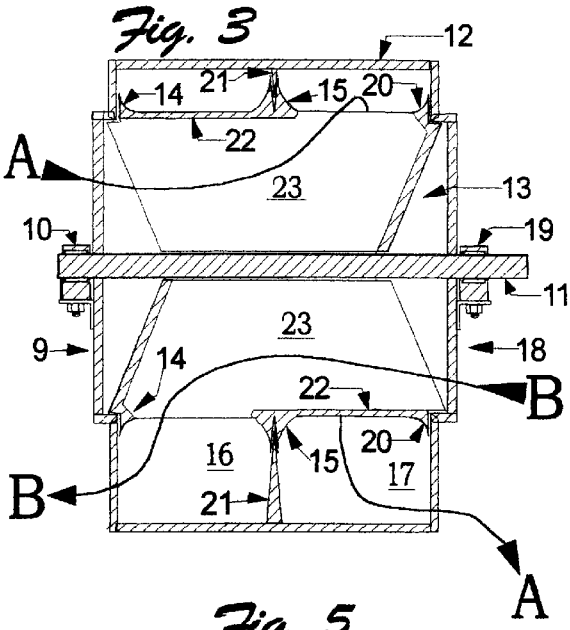
FIG. 3 is a plain front view of the centrifugal device that has two exit openings.
Figure 4:
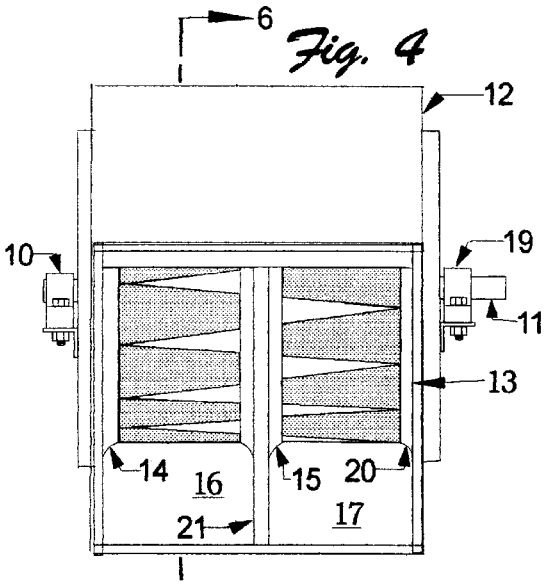
FIG. 4 is a sectional front view of the centrifugal device.
Figure 5:
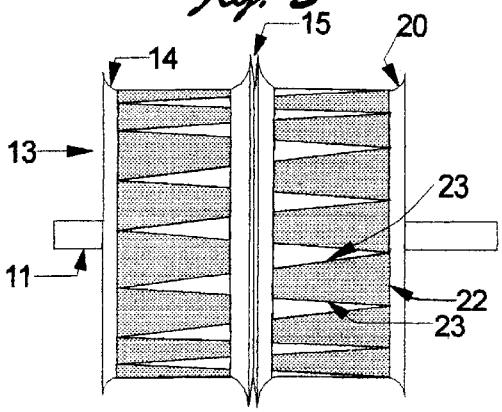
FIG. 5 is a plain front view of the centrifugal fan blades assembly of the device.
Figure 6:
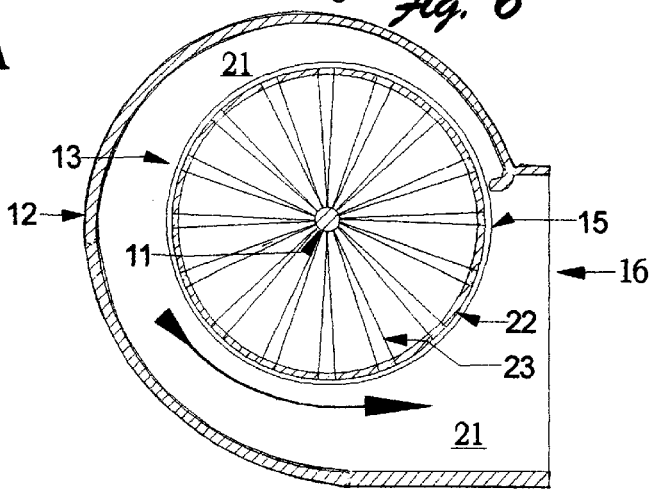
FIG. 6 is a sectional side view of the centrifugal device.
Figure 7:
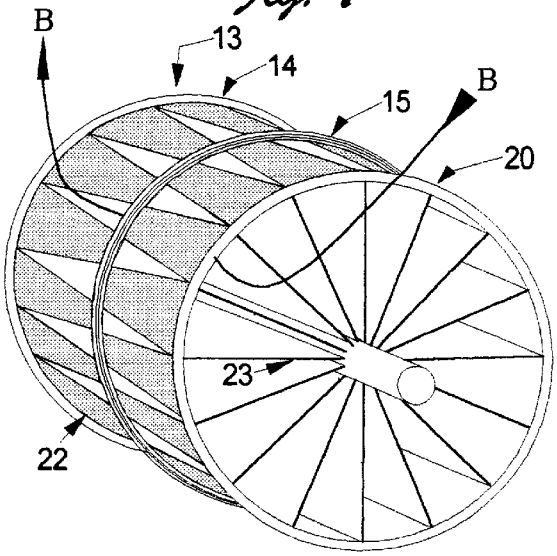
FIG. 7 is a view of the centrifugal fan blades assembly of the device looking down at an angle from a corner.
Figure 8:
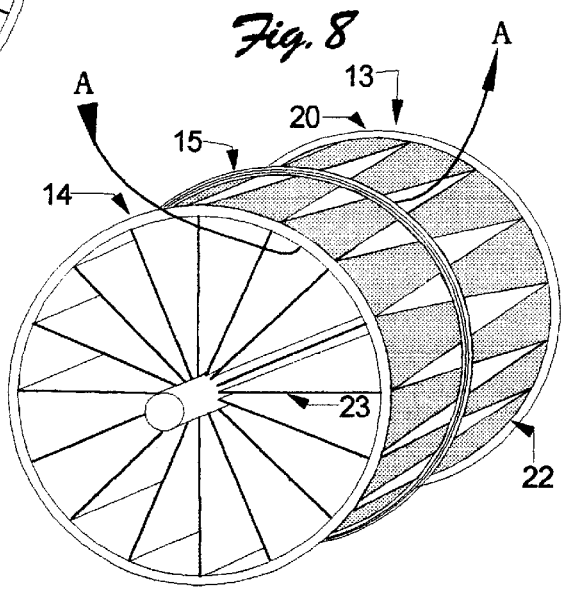
FIG. 8 is a view of the centrifugal fan blades assembly of the device looking down at an angle from the opposite corner.

Referring now to the drawings and the preferred embodiments of the invention, FIG. 1 shows one side of the device that has an opening 9, a bearing attachment 10 for attaching the shaft 11 of the centrifugal fan blades assembly 13 to the housing 12 of the device, an air seal 14, and sectional reference 3—3 to FIG. 3. FIG. 2 shows the opposite side of the device that has an opening 18, another bearing attachment 19 for attaching the opposite end of the shaft 11 of the centrifugal fan blades assembly 13 to the housing 12 of the device and another air seal 20. FIG. 3 is a sectional view of the device which shows two bearing attachments 10, 19 for attaching shaft 11 to the centrifugal fan blades assembly 13 with it's plates 22, blades 23, and three air seal devices 14, 15, 20 to the housing 12; partition 21 is attached to the housing 12 of the device; one opening on each side of the device for air to enter the device, one inlet opening 9 for air stream A and the other inlet opening 18 for air stream B; and the two openings for exiting air on the front side of the device, one exit opening 16 is for exhausting air stream B and the other opening 17 is for exhausting air stream A. FIG. 4 shows the centrifugal fan blades assembly 13 with three air seals 14, 15, 20 mounted inside the housing, 12; two bearing attachments 10, 19; shaft 11; two openings for exiting air on the front side of the device, one exit opening 16 and the other exit opening 17 with partition 21 that is a part of the housing separates the internal space of the device; and sectional reference 6—6 to FIG. 6. FIG. 5 shows shaft 11 attached to the front view of the centrifugal fan blades assembly 13 with three air seals 14, 15, and 20 that are rims around their outer circumferences; plates 22 joining pairs of adjoining blades 23. FIG. 6 shows the sectional view of the device that has partition 21 attached to housing 12; shaft 11 attached to centrifugal fan blades assembly 13 with plates 22, blades 23, and air seal 15; opening 16; and reference rotational arrow of the centrifugal fan blades assembly 13. FIG. 7 shows the centrifugal fan blades assembly 13 with three air seals 20, 15, 14; plates 22; blades 23; and air flow reference of air stream B. FIG. 8 shows the centrifugal fan blades assembly 13 with three air seals 14, 15, 20; plates 22; blades 23; and air flow reference of air stream A.

While the invention has been shown and described with reference to the preferred embodiment thereof, it will be understood by those skilled in the art that various changes in form and details can be made therein without departing form the spirit and scope of the invention.

What is claimed is:

1. A centrifugal fan device that simultaneously moves two separate and distinct air streams in separate and distinct directions and supports the transfer of energy from one air stream to the other arranged in the fashion: air tight housing except for four opening in said housing, a first circular opening in one side of said device for the intake of first air from a first air source, a second circular opening in the opposite side of the device for the intake of second air from a second air source, separate openings in the front side of the device for the exits of said first air and said second air, a straight cylindrical shaft that runs from said first circular opening through said device to said second circular opening, a first bearing attachment is affixed to said housing at said first circular opening and a second bearing attachment is affixed at said second circular opening, a first end of said shaft is placed in said first bearing attachment, the second end of said shaft is placed in said second bearing attachment, said first end of said shaft is held at the center of said first circular opening by said first bearing attachment, said second end of said shaft is held at the center of said second circular opening by said second bearing attachment, an internal partition is a part of said housing of said device, said partition runs perpendicular to said shaft and is at the center of said device, said partition divides the internal space of said device into an internal side one and an internal side two, said internal side one of said device has said first circular opening, said internal side two of said device has said second circular opening, a first air seal is located at said first circular opening, said first air seal has a rim, the outer circumference of said rim is grooved, the outer circumference edge of said first circular opening fits inside said groove of said rim of said first air seal, blades run from said rim of said first air seal to the rim of a second air seal and continue to run to the rim of a third air seal, the top edges of pairs of said blades from triangles whose base is at said rim of said first air seal and whose apex is at said rim of said third air seal, the top edges of each pair of said blades is attached to a plate, said plate is tangential to said top edges of said blades, the bottom of said plate forms a channel with said pair of said blades, an end of said plate is attached to said rim of said first air seal, the opposite end of said plate is attached to said rim of said second air seal, thus said plate and said channel run from said rim of said first air seal to said rim of said second air seal, the bottom edges of each of said blades is attached to said shaft near said second air seal, the outer circumference of said rim of said third air seal is grooved, the outer circumference edge of said second circular opening fits inside said groove of said rim of said third air seal, blades run from said rim of said third air seal to the rim of said second air seal and continue to run to the rim of said first air seal, the top edges of pairs of said blades form triangles whose base is at said rim of said third air seal and whose apex is at said rim of said first air seal, the top edges of each pair of said blades is attached to a plate, said plate is tangential to said top edges of said blades, the bottom of said plate forms a channel with said pair of said blades, an end of said plate is attached to said rim of said third air seal, the opposite end of said plate is attached to said rim of said second air seal, thus said plate and said channel run from said rim of said third air seal to said rim of said second air seal, the bottom edges of each of said blades is attached to said shaft near said second air seal, the outer circumferences of said rim of said second air seal is grooved, the inner circumferences edge of said internal partition fits inside said groove of said rim of said second air seal, each said blade of said device has a first side and a second side, on said internal side one of the device said first side of each blade forms a channel with an adjacent blade and a plate and said second side forms a first leg of the apex of a triangle, the adjacent blade on the second side of the blade forms the second leg of said apex of said triangle, on said internal side two of the device said first side of said blade forms a first leg of the apex of a triangle, the adjacent blade on the second side of the blade forms the second leg of said apex of said triangle, said first side of said blade forms a channel with an adjacent blade and a plate, all of said blades and plates are made of heat conductive materials.

* * * * *